US007360875B2

(12) United States Patent
Terakura et al.

(10) Patent No.: US 7,360,875 B2
(45) Date of Patent: Apr. 22, 2008

(54) INKJET HEAD

(75) Inventors: Tatsuo Terakura, Nagoya (JP); Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 205 days.

(21) Appl. No.: 10/902,093

(22) Filed: Jul. 30, 2004

(65) Prior Publication Data

US 2005/0036010 A1 Feb. 17, 2005

(30) Foreign Application Priority Data

Aug. 12, 2003 (JP) ..... 2003-292583

(51) Int. Cl.
*B41J 2/045* (2006.01)

(52) U.S. Cl. ..... 347/71

(58) Field of Classification Search ..... 347/68–72; 29/25.35, 890.1

See application file for complete search history.

(56) References Cited

U.S. PATENT DOCUMENTS 5,779,837 A 7/1998 Harvey
6,361,155 B1 3/2002 Kanda et al.
6,536,879 B2 3/2003 Ito et al.
2002/0135643 A1 9/2002 Sarojiniamma et al.
2003/0067511 A1* 4/2003 Okazawa ..... 347/68

FOREIGN PATENT DOCUMENTS

JP 11-157063 6/1999
JP A 2002-096477 4/2002
JP A 2002-96477 4/2002

* cited by examiner

*Primary Examiner*—Stephen Meier
*Assistant Examiner*—Geoffrey S. Mruk
(74) *Attorney, Agent, or Firm*—Oliff & Berridge, PLC

(57) ABSTRACT

An inkjet head includes a flow-path unit and a piezoelectric element. The flow-path unit includes a plurality of plates that are stacked and define a common ink chamber, and a plurality of ink flow paths communicating with the common ink chamber and a nozzle. The piezoelectric element is bonded onto one of the plates by an adhesive. The first plate defines, on one surface onto which the piezoelectric element is bonded, a first groove that extends in a first direction and a plurality of recess portions on one side of the first groove in a second direction, which intersects with the first direction. The recess portions are spaced from each other.

15 Claims, 14 Drawing Sheets

INKJET HEAD

BACKGROUND OF THE INVENTION

1. Field of the Invention

The present invention relates to an inkjet head used for an inkjet recording apparatus for ejecting ink onto a recording medium to perform printing.

2. Description of the Related Art

A certain inkjet head used for an inkjet recording apparatus for ejecting ink onto a recording medium to perform printing is constructed such that ink supplied from an ink tank to a manifold is distributed to plural pressure chambers, and pulse-like pressures are selectively applied to these plural pressure chambers so that ink is ejected from nozzles communicating with the pressure chambers. In such an inkjet head, a flow-path unit including pressure chambers, manifolds, nozzles and/or ink flowpaths for connecting these is constructed by laminating plural plates having openings and holes for forming the pressure chambers and the like. Further, an actuator unit for changing volumes of the pressure chambers to eject the ink from the nozzles is disposed on, among the plural plates, a cavity plate that defines the pressure chambers. Here, there is a case where for example, a piezoelectric sheet is used as the actuator unit, and in that case, the piezoelectric sheet is laminated on the cavity plate.

Plural plates constituting the flow-path unit and the actuator unit are generally bonded by adhesive and are laminated to each other. However, when two plates are bonded to each other, for example, in a case where the amount of the adhesive is large or the adhesive is unevenly applied, there is a fear that the surplus adhesive overflows from between the two plates. Then, there has been proposed to form an escape groove for escaping surplus adhesive in the outer peripheral part of a plate along the outer peripheral shape of the plate (see, for example, JP-A-2002-96477 (FIG. 4)).

SUMMARY OF THE INVENTION

In the case where the foregoing plural plates are bonded, the adhesive is generally transferred to a plate surface by a bonding tool or a roller and is applied. In this case, the adhesive flows from an upstream side to a downstream side in a transfer direction. However, in the inkjet head of JP-A-2002-96477, merely the escape groove along the outer shape of the plate is formed. There is also a case where it is difficult to sufficiently escape a large amount of adhesive flowing from the upstream side in the transfer direction by only this escape groove. Then, when the width of the escape groove is widen, it may become possible to escape the adhesive flowing from the upstream side in the transfer direction. However, the wider the width of the escape groove is made, the wider a thin portion of the plate becomes. As a result, the strength of the plate is lowered at that portion.

The invention surely escapes the surplus adhesive when the two plates are bonded to each other and prevents adhesive from overflowing from between two plates; and also ensures the strength of a portion where an escape groove for adhesive is formed.

According to one embodiment of the invention, an inkjet head includes a flow-path unit and a piezoelectric element. The flow-path unit includes a plurality of plates that are stacked and define a common ink chamber and a plurality of ink flow paths communicating with the common ink chamber and a nozzle. The piezoelectric element is bonded onto one of the plates by an adhesive. The first plate defines, on one surface onto which the piezoelectric element is bonded, a first groove that extends in a first direction and a plurality of recess portions on one side of the first groove in a second direction, which intersects with the first direction. The recess portions are spaced from each other.

In this inkjet head, the flow-path unit includes the plurality of plates that are stacked and define the common ink chamber and the plurality of ink flow paths communicating with the common ink chamber and the nozzle. The piezoelectric sheet is bonded onto the one of the plates by the adhesive. At this time, for example, when the amount of the adhesive between the one of the plates and the piezoelectric sheet is large or the adhesive is partially uneven, in order to prevent the surplus adhesive from overflowing from between the one of the plates and the piezoelectric sheet, the first groove extends in the first direction on the one surface of the one of the plates.

Further, the one of the plates defines the plurality of recess portions on the one side of the first groove in the second direction, which intersects with the first direction. Thus, the recess portions can escape the adhesive, which cannot be escaped by the first escape groove. It is possible to certainly prevent the adhesive from overflowing from between the one of the plates and the piezoelectric sheet. Here, since the recess portions are spaced from each other, a portion where a plate thickness becomes thin by the formation of the recess portions does not continue. The strength can be ensured even in the portion where the plural recess portions are defined. Since the recess portions, together with the first groove, prevent the adhesive from overflowing from between the one of the plates and the piezoelectric sheet, it is preferable that the recess portions are defined in the vicinity of the first groove.

BRIEF DESCRIPTION OF THE DRAWINGS

FIG. 8 is views showing an actuator unit, in which

FIG. 10 is partial enlarged views of FIG. 9, in which

DETAILED DESCRIPTION OF THE PREFERRED EMBODIMENT

Figure 1:
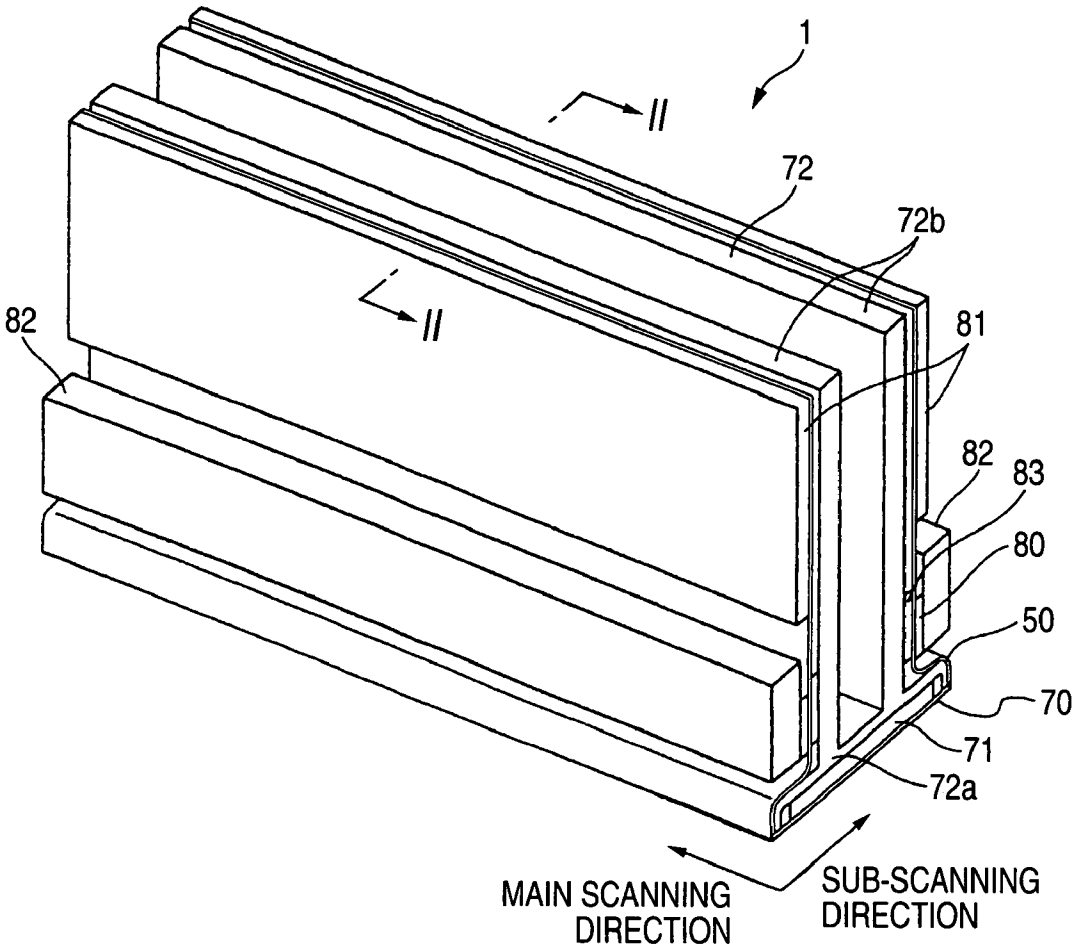
FIG. 1 is a perspective view of an inkjet head according to an embodiment of the invention.

An embodiment of the invention will be described. As shown in FIG. 1, an inkjet head 1 of this embodiment includes a head main body 70 and a base block 71. The head main body 70 ejects ink onto a sheet, extends in a main scanning direction, and has a rectangular plane shape. The base block 71 is disposed above the head main body 70. In the base block 71, two ink reservoirs 3 that function as flow paths of ink supplied to the head main body 70 are formed.

The head main body 70 includes a flow-path unit 4 in which the ink flow paths are formed, and plural actuator units 21 bonded to the upper surface of the flow-path unit 4. The flow-path unit 4 and the actuator units 21 are constructed such that plural thin plates are laminated and bonded to each other. A flexible printed circuit (FPC) 50 functioning as a feeding member is bonded to the upper surface of the actuator unit 21, and is led out to both sides. The base block 71 is made of metal material, for example, stainless. The ink reservoir 3 in the base block 71 is substantially a rectangular parallelepiped hollow area formed along the longitudinal direction of the base block 71.

A lower surface 73 of the base block 71 protrudes downward from a surrounding area, in the vicinity of an opening 3*b*. The base block 71 is in contact with the flow-path unit 4 only at a portion 73*a* near the opening 3*b* of the lower surface 73. Thus, an area other than the portion 73*a* near the opening 3*b* of the lower surface 73 of the base block 71 is separate from the head main body 70, and the actuator unit 21 is disposed in this separate portion.

The base block 71 is bonded and fixed to a recess formed in the lower surface of a grip part 72*a* of a holder 72. The holder 72 includes the grip part 72*a* and a pair of protrusions 72*b* that extend from the upper surface of the grip part 72*a* in a direction orthogonal to this and are spaced from each other by a specified interval. The FPC 50 bonded to the actuator unit 21 is arranged along the surface of each of the projections 72*b* of the holder 72 through an elastic member 83 such as a sponge. A driver IC 80 is disposed on the FPC 50 arranged on the surface of the projection 72*b* of the holder 72. In order to send a drive signal outputted from the driver IC 80 to the actuator unit 21 (described later in detail) of the head main body 70, the FPC 50 is electrically connected to the both of the drive IC 80 and the actuator unit 21 by soldering.

Since a heat sink 82 having substantially a rectangular parallelepiped shape is disposed to be in close contact with the outer surface of the driver IC 80, heat generated by the driver IC 80 can be efficiently dissipated. A board 81 is disposed above the driver IC 80 and the heat sink 82 and outside the FPC 50. Seal members 84 are respectively disposed between the upper surface of the heat sink 82 and the board 81, and between the lower surface of the heat sink 82 and the FC 50 to bond them.

Figure 3:
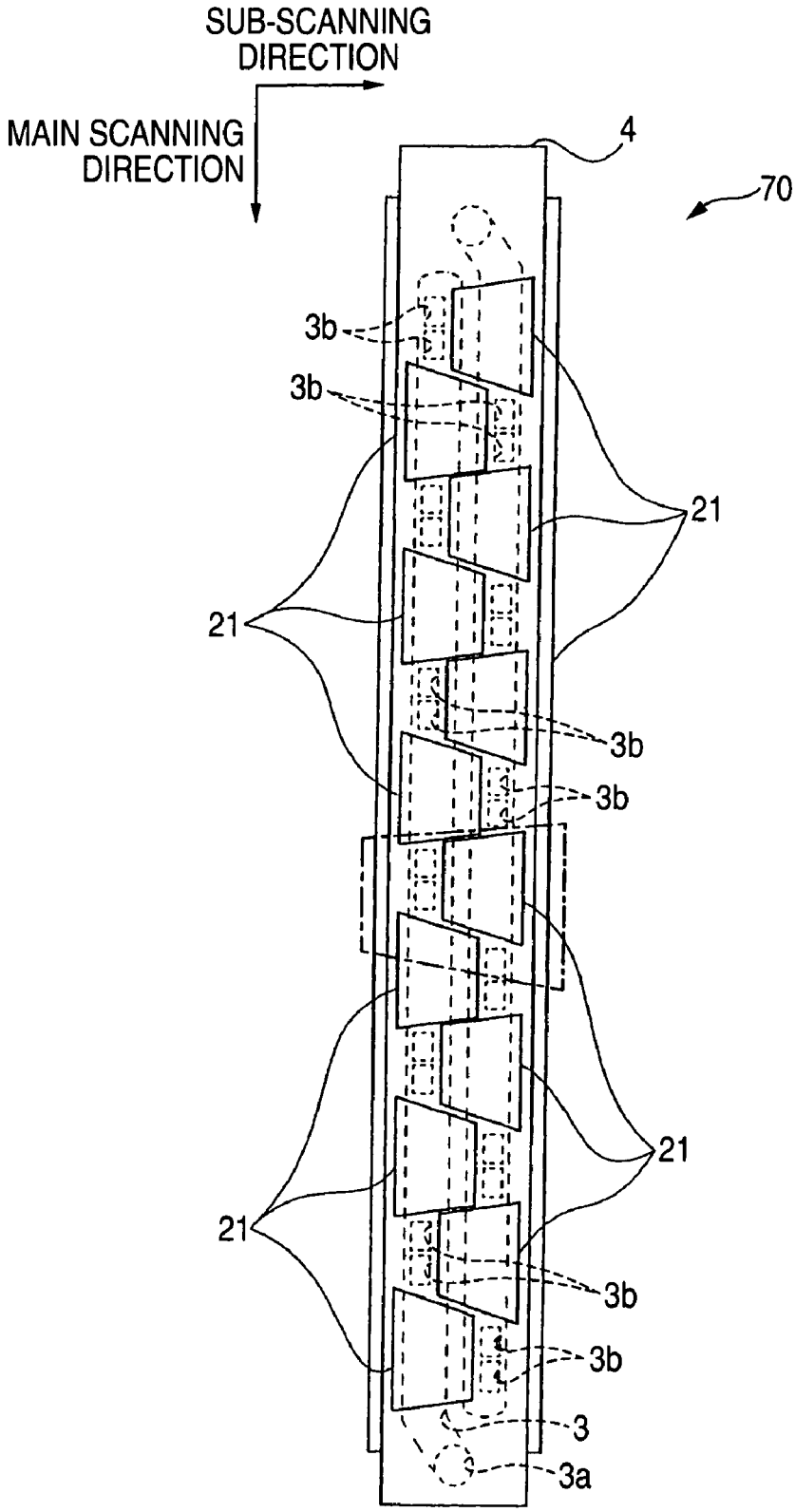
FIG. 3 is a plan view of a head main body.

FIG. 3 is a plan view of the head main body 70 shown in FIG. 1. In FIG. 3, the ink reservoirs 3 formed in the base block 71 are imaginarily shown by broken lines. The two ink reservoirs 3 extend in parallel to each other in the longitudinal direction of the head main body 70 and are spaced from each other by a specified interval. Each of the two ink reservoirs 3 has an opening 3*a* at one end and communicates with an ink tank (not shown) through this opening 3*a*, so that it is always filled with ink. The many openings 3*b* are provided in the respective ink reservoirs 3 in the longitudinal direction of the head main body 70, and connect the respective ink reservoirs 3 and the flow-path unit 4 as described above. The many openings 3*b* include pairs and the two openings of each of the pairs are disposed to be close to each other in the longitudinal direction of the head main body 70. The pairs of the openings 3*b* communicating with the one ink reservoir 3 and the pairs of the openings 3*b* communicating with the other ink reservoir 3 are arranged in a staggered manner.

In the areas where the openings 3*b* are not arranged, the plural actuator units 21 having trapezoidal shapes in the plan view are arranged in a staggered manner and in a pattern opposite to the pairs of the openings 3*b*. Parallel opposite sides (upper side and lower side) of each of the actuator units 21 are parallel to the longitudinal direction of the head main body 70. Parts of oblique sides of the adjacent actuator units 21 overlap with each other in a width direction of the head main body 70.

Figure 4:
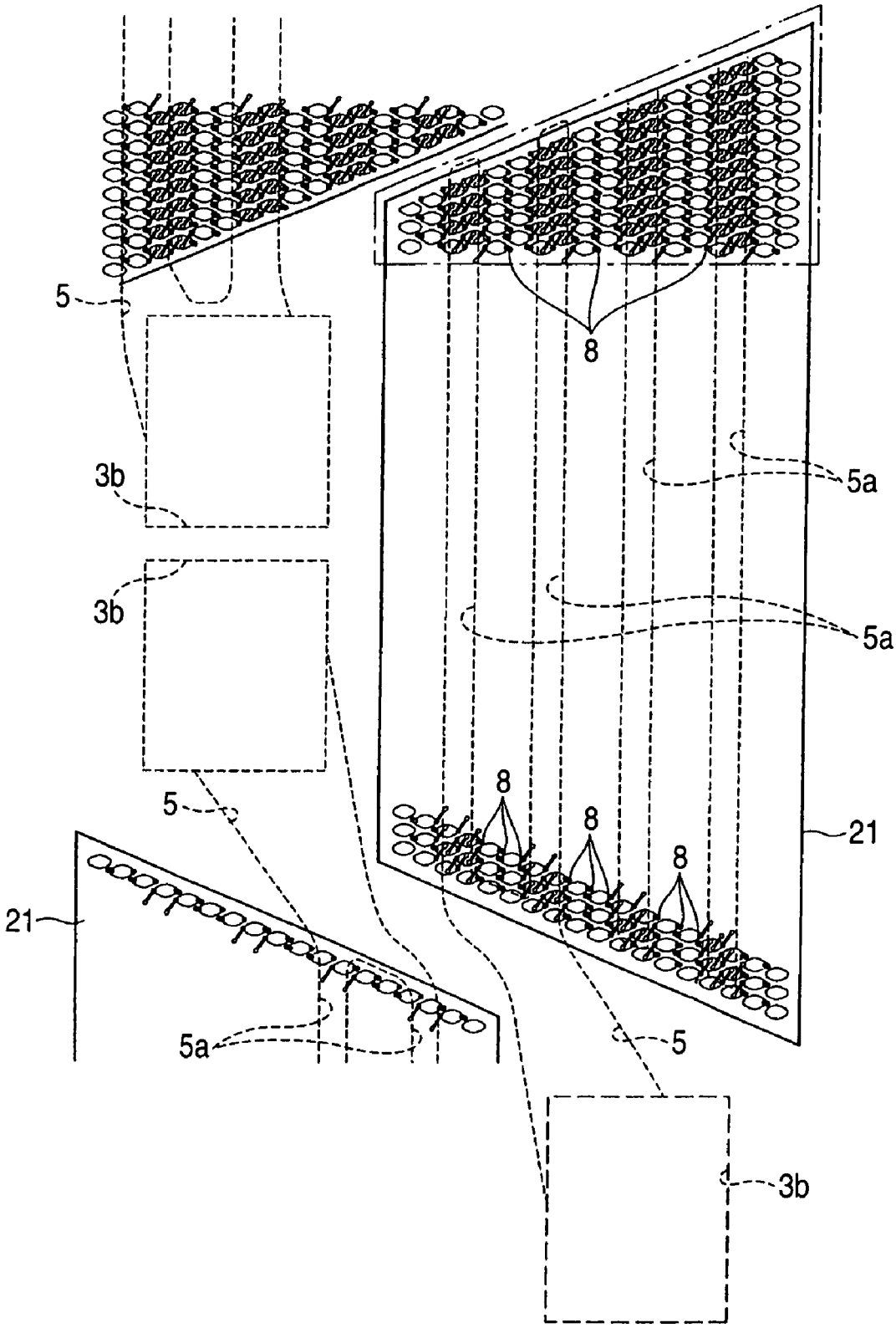
FIG. 4 is an enlarged view of an area surrounded by a one-dot chain line of FIG. 3.

FIG. 4 is an enlarged view of an area surrounded by a one-dot chain line drawn in FIG. 3. As shown in FIG. 4, the openings 3*b* provided for each of the ink reservoirs 3 communicate with manifolds 5 functioning as common ink chambers. A tip end of each of the manifolds 5 branches into two and forms sub-manifolds 5*a* functioning as common ink chambers. Besides, when viewed on a plane, the two sub-manifolds 5*a* branching from the adjacent opening 3*b* extend from each of the two oblique sides of the actuator unit 21. That is, under the actuator unit 21, the four sub-manifolds 5*a* separate from each other extend along the parallel opposite sides of the actuator unit 21.

The lower surface of the flow-path unit 4 corresponding to the bonding area of the actuator unit 21 is an ink ejection area. Many nozzles 8 are arranged in a matrix form on the surface of the ink ejection area as described later. For the purpose of simplifying the drawing, only some of the nozzles 8 are shown in FIG. 4, however, the nozzles 8 are actually disposed all over the ink ejection area.

Figure 5:
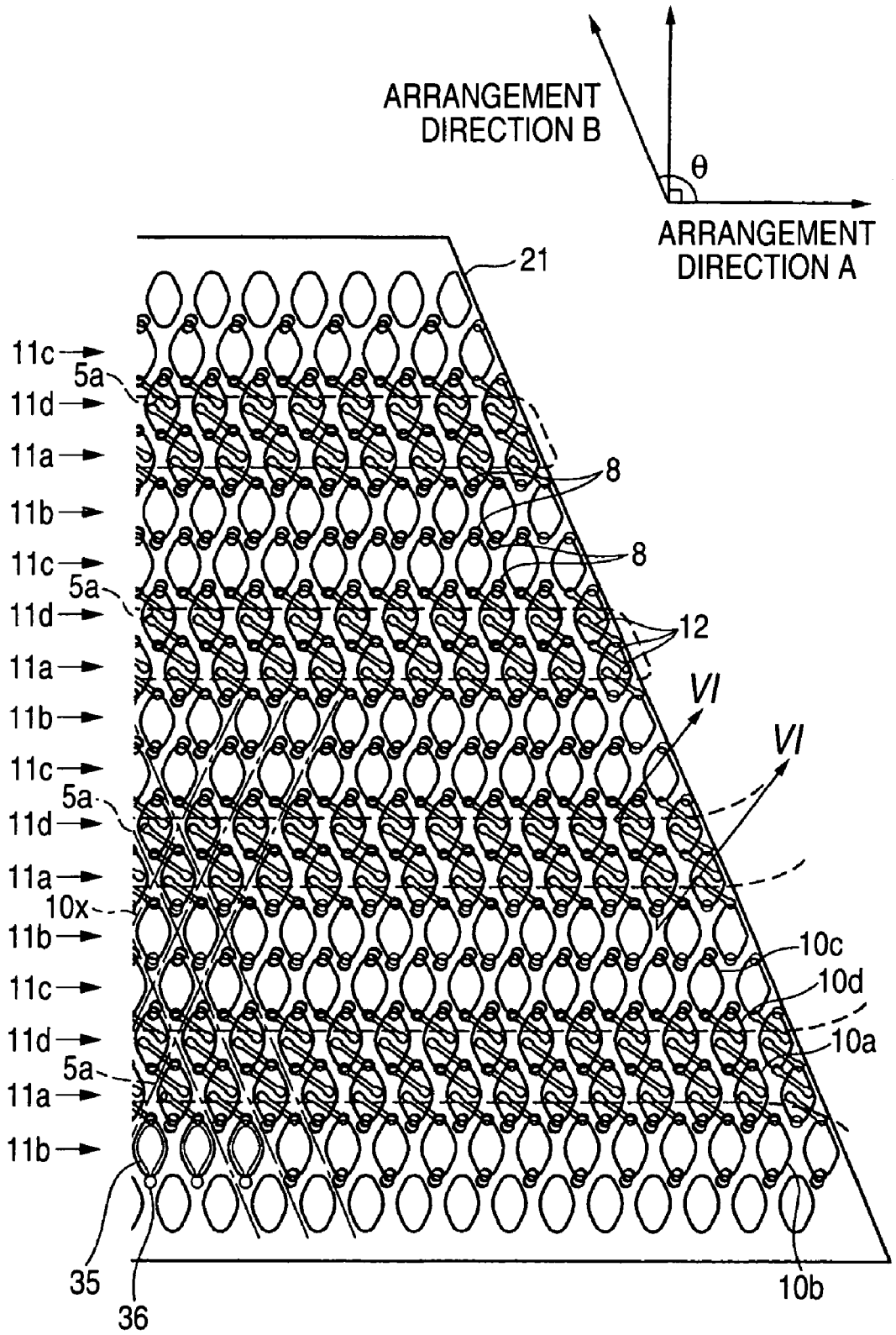
FIG. 5 is an enlarged view of an area surrounded by a one-dot chain of FIG. 4.

FIG. 5 is an enlarged view of an area surrounded by a one-dot chain line shown in FIG. 4. FIGS. 4 and 5 show a state where a plane on which many pressure chambers 10 of the flow-path unit 4 are arranged in a matrix form is seen in a direction vertical to the ink ejection surface. Each of the pressure chambers 10 has a parallelogram shape in the plan view in which each corner part is curved and a longer diagonal thereof line is parallel to the width direction of the flow-path unit 4. One end of each of the pressure chambers 10 communicates with the nozzle 8. The other end thereof communicates with the sub-manifold 5*a* functioning as the common ink flow path through an aperture 12 (see FIG. 6). When viewed on a plane, at a position overlapping with each of the pressure chambers 10, an individual electrode 35 having a similar shape in the plan view to the pressure chamber 10 and one size smaller than the pressure chamber 10 is formed on the actuator unit 21. FIG. 5 shows only some of the many individual electrodes 35 to simplify the drawing. Incidentally, in FIGS. 4 and 5, for the purpose of making the drawings plain, the pressure chambers 10, the apertures 12 and the like which exist in the actuator unit 21 or the flow-path unit 4 and should be drawn by broken lines, are drawn by solid lines.

In FIG. 5, plural imaginary rhombic areas 10*x* in which the pressure chambers 10 (10*a*, 10*b*, 10*c*, 10*d*) are respectively contained are adjacently arranged in a matrix form in two directions, that is, an arrangement direction A and an arrangement direction B. Thus, the rhombic areas 10*x* do not overlap with one another and have the respective sides in common. The arrangement direction A is the longitudinal direction of the inkjet head 1, that is, the extension direction of the sub-manifold 5*a*, and is parallel to a short diagonal line of the rhombic area 10$x$. The arrangement direction B is a direction of one oblique line of the rhombic area 10$x$ forming an obtuse angle θ with respect to the arrangement direction A. The pressure chamber 10 and the corresponding rhombic area 10$x$ share the center position. Borderlines of the both are separate from each other when viewed on a plane.

The pressure chambers 10 adjacently arranged in a matrix form in the two directions of the arrangement direction A and the arrangement direction B are separate from each other by a distance equivalent to 37.5 dpi in the arrangement direction A. Besides, in one ink ejection area, 16 pressure chambers 10 are disposed in the arrangement direction B. The pressure chambers 10 at both ends in the arrangement direction B are dummy and do not contribute to ink ejection.

The plural pressure chambers 10 disposed in the matrix form constitute plural pressure chamber lines along the arrangement direction A as shown in FIG. 5. The pressure chamber lines are classified into a first pressure chamber line 11$a$, a second pressure chamber line 11$b$, a third pressure chamber line 11$c$, and a fourth pressure chamber line 11$d$ according to the relative position to the sub-manifold 5$a$ when viewed in a direction vertical to the paper surface of FIG. 5. These first to fourth pressure chamber lines 11$a$ to 11$d$ are periodically arranged in units of four in sequence of 11$c$→11$d$→11$a$→11$b$→11$c$→11$d$→. . . →11$b$ from the upper side of the actuator unit 21 to the lower side thereof.

In pressure chambers 10$a$ constituting the first pressure chamber line 11$a$ and pressure chambers 10$b$ constituting the second pressure chamber line 11$b$, with respect to a direction orthogonal to the arrangement direction A when viewed in the direction vertical to the paper surface of FIG. 5, the nozzles 8 are unevenly distributed on the lower side of the paper surface of FIG. 5. The nozzles 8 are respectively positioned at the lower ends of the corresponding rhombic areas 10$x$. On the other hand, in pressure chambers 10$c$ constituting the third pressure chamber line 11$c$ and pressure chambers 10$d$ constituting the fourth pressure chamber line 11$d$, with respect to the fourth direction, the nozzles 8 are unevenly distributed on the upper side of the paper surface of FIG. 5. The nozzles 8 are respectively positioned at the upper ends of the corresponding rhombic areas 10$x$. In the first and fourth pressure chamber lines 11$a$ and 11$d$, when viewed in the direction vertical to the paper surface of FIG. 5, half or more of the pressure chambers 10$a$ and 10$d$ overlap with the sub-manifold 5$a$. In the second and third pressure chamber lines 11$b$ and 11$c$, none of areas of the pressure chambers 10$b$ and 10$c$ overlap with the sub-manifold 5$a$. Thus, with regard to the pressure chamber 10 belonging to any pressure chamber line, while the nozzle 8 communicating with this pressure chamber 10 does not overlap with the sub-manifold 5$a$, the width of the sub-manifold 5$a$ is formed as wide as possible. As a result, ink can be smoothly supplied to the respective pressure chambers 10.

Figure 6:
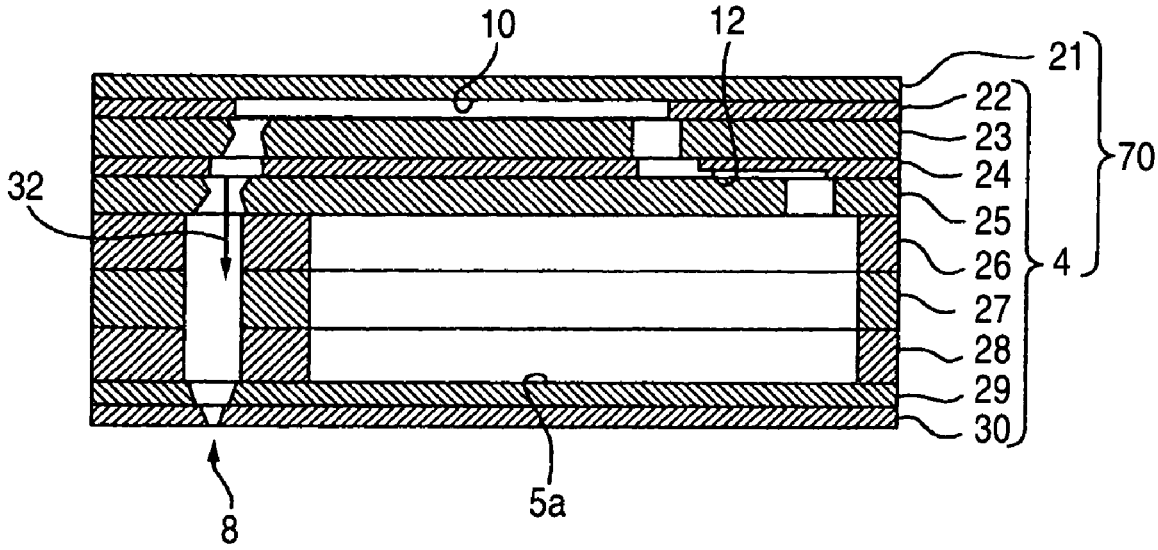
FIG. 6 is a sectional view taken along line VI-VI of FIG. 5.

Next, a sectional structure of the head main body 70 will be further described with reference to FIGS. 6 and 7. As shown in FIG. 6, each of the nozzles 8 communicates with the sub-manifold 5$a$ through the pressure chamber 10 and the aperture 12. In this way, an individual ink path 32 extending from an outlet of the sub-manifold 5$a$ through the aperture 12 and the pressure chamber 10 to the nozzle 8 is formed for each of the pressure chambers 10.

As shown in FIG. 6, the pressure chamber 10 and the aperture 12 are provided at different depths in the lamination direction of plural thin plates. According to this configuration, as shown in FIG. 5, in the flow-path unit 4 corresponding to the ink ejection area under the actuator unit 21, the aperture 12 communicating with one pressure chamber 10 can be arranged at the same position as another pressure chamber 10 adjacent to the one pressure chamber 10 when viewed on a plane. As a result, since the pressure chambers 10 are arranged closely and at high density, high resolution image printing can be realized by the inkjet head 1 having a relatively small occupied area.

Figure 7:
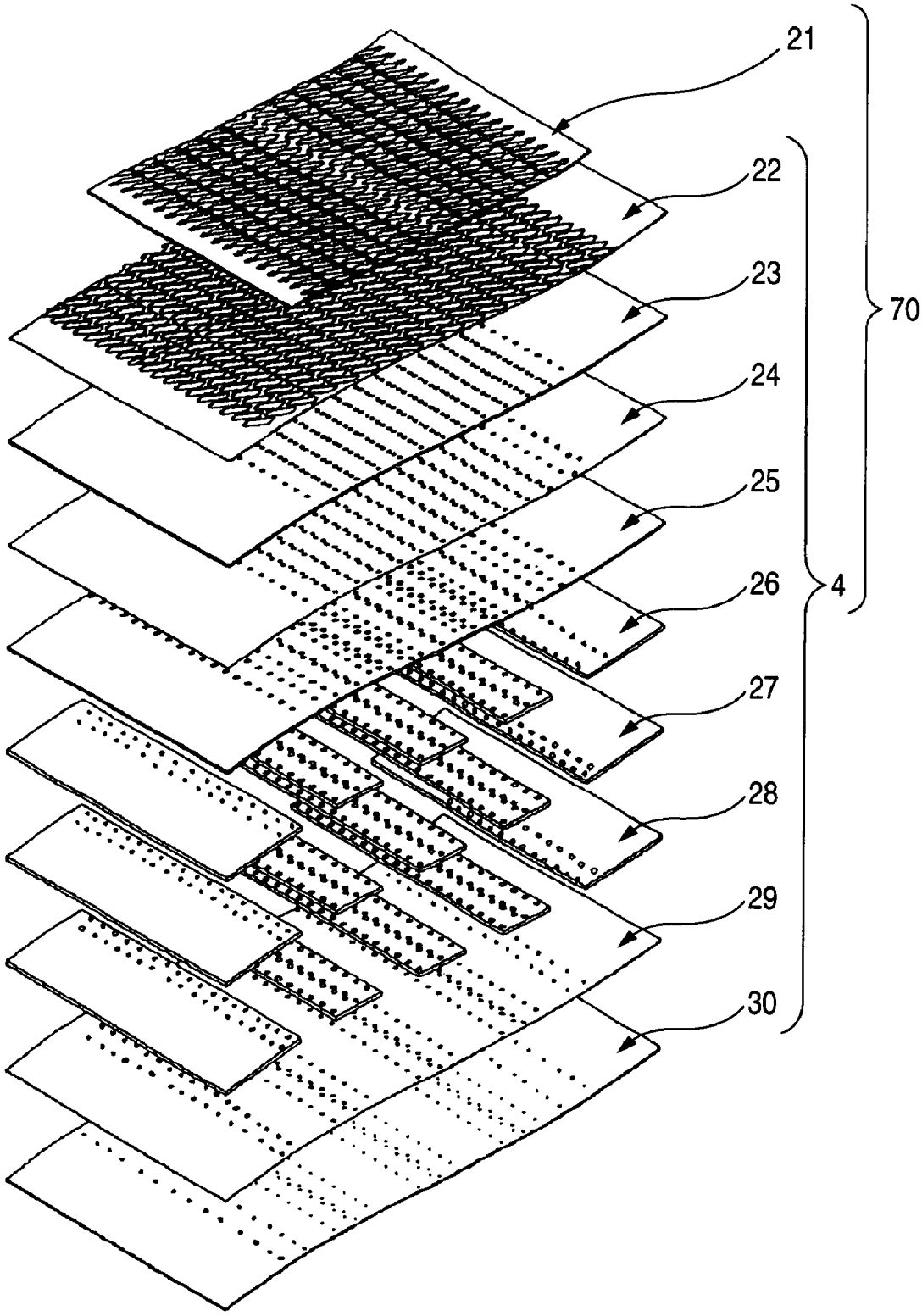
FIG. 7 is a partial exploded perspective view of a head main body.

As shown in FIG. 7, the head main body 70 has a lamination structure in which ten sheet-like members in total, that is, an actuator unit 21, a cavity plate 22, a base plate 23, an aperture plate 24, a supply plate 25, manifold plates 26, 27 and 28, a cover plate 29 and a nozzle plate 30 from the top are laminated. Among these, the nine plates except the actuator unit 21 constitute the flow-path unit 4.

As described later, the actuator unit 21 is configured such that four piezoelectric sheets 41 to 44 (see FIG. 8A) are laminated. An electrode is disposed thereon so that only the uppermost layer thereof is a layer (hereinafter simply referred to as "a layer including an active layer") having a portion which becomes an active layer at the time of electric field application, and the three remaining layers are non-active layers. The cavity plate 22 is a metal plate in which many substantially rhombic openings corresponding to the pressure chambers 10 are provided. The base plate 23 is a metal plate in which with respect to one of the pressure chambers 10 of the cavity plate 22, a communication hole between the pressure chamber 10 and the aperture 12 and a communication hole between the pressure chamber 10 and the nozzle 8 are provided. The aperture plate 24 is a metal plate in which with respect to one of the pressure chambers 10 of the cavity plate 22, in addition to the aperture 12 formed of two holes and a half-etched area to connect them, a communication hole from the pressure chamber 10 to the nozzle plate 8 is provided. The supply plate 25 is a metal plate in which with respect to one of the pressure chambers 10 of the cavity plate 22, a communication hole between the aperture 12 and the sub-manifold 5$a$ and a communication hole from the pressure chamber 10 to the nozzle 8 are provided. The manifold plates 26, 27 and 28 are metal plates in which with respect to one of the pressure chambers 10 of the cavity plate 22, in addition to the sub-manifold 5$a$, communication holes from the pressure chamber 10 to the nozzle 8 are provided. The cover plate 29 is a metal plate in which with respect to one of the pressure chambers 10 of the cavity plate 22, a communication hole from the pressure chamber 10 to the nozzle plate 8 is provided. The nozzle plate 30 is a metal plate in which with respect to one of the pressure chambers 10 of the cavity plate 22, the nozzle 8 is provided.

These ten sheets 21 to 30 are positioned and laminated to each other so that the individual ink path 32 as shown in FIG. 6 is formed. The individual ink flow path 32 first goes upward from the sub-manifold 5$a$, extends horizontally in the aperture 12, further goes upward, extends horizontally again in the pressure chamber 10, slightly goes obliquely downward in a direction of moving away from the aperture 12, and goes vertically downward toward the nozzle 8.

Figure 8A:
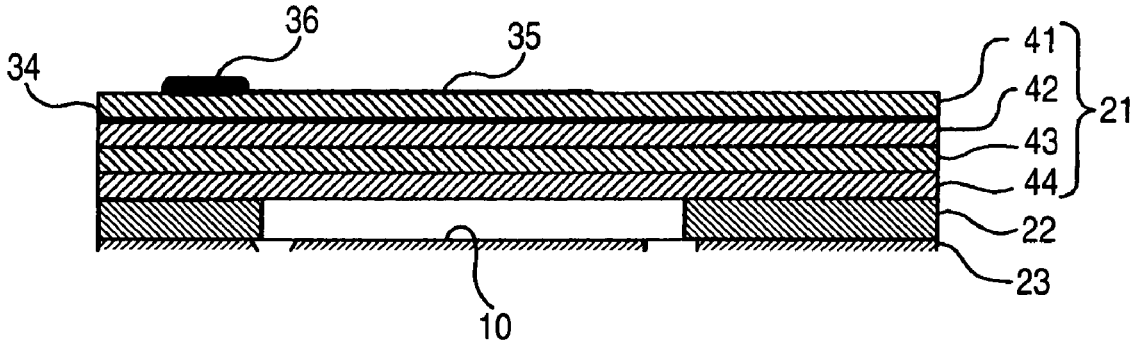
FIG. 8A is a sectional view of the actuator unit.
Figure 8B:
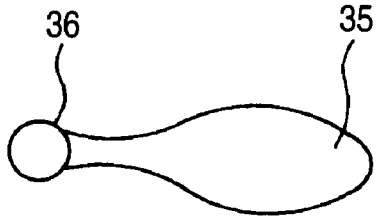
FIG. 8B is a plan view showing an individual electrode.

Next, a structure of the actuator unit 21 laminated on the cavity plate 22 of the uppermost layer of the flow-path unit 4 will be described. FIG. 8A is a partial enlarged sectional view of the actuator unit 21 and the pressure chamber 10. FIG. 8B is a plan view showing a shape of the individual electrode 35 bonded to the surface of the actuator unit 21.

As shown in FIG. 8A, the actuator unit 21 includes the four piezoelectric sheets 41 to 44 each formed to have a same thickness of about 15 μm. These piezoelectric sheets 41 to 44 are continuous laminar flat plates (continuous flat plate layers) arranged to extend over the many pressure chambers 10 formed in one ink ejection area of the head main body 70. The piezoelectric sheets 41 to 44 are arranged, as the continuous flat plate layers, to extend over the many pressure chambers 10, so that the individual electrodes 35 can be arranged on the piezoelectric sheet 41 at high density by using, for example, a screen printing technique. Thus, the pressure chambers 10 formed at positions corresponding to the individual electrodes 35 can also be arranged at high density. Also, printing of a high resolution image becomes possible. The piezoelectric sheets 41 to 44 are made of ceramic material of lead zirconate titanate (PZT) having ferroelectricity.

The individual electrode 35 is formed on the piezoelectric sheet 41 of the uppermost layer. A common electrode 34 formed on the whole surface of the sheet and having a thickness of about 2 μm intervenes between the piezoelectric sheet 41 of the uppermost layer and the lower piezoelectric sheet 42. Both the individual electrode 35 and the common electrode 34 are made of metal material such as Ag-Pd.

The individual electrode 35 has a thickness of approximately 1 μm. As shown in FIG. 8B, the individual electrode 35 has substantially a rhombic shape in the plan view almost similar to the pressure chamber 10 shown in FIG. 5. One of acute angle parts of the substantially rhombic individual electrode 35 is extended, and its end is provided with a circular land part 36 electrically connected to the individual electrode 35 and having a diameter of about 160 μm. The land part 36 is made of, for example, gold containing glass frit. As shown in FIG. 8A, the land part 36 is bonded onto the surface of an extension part of the individual electrode 35.

Figure 2:
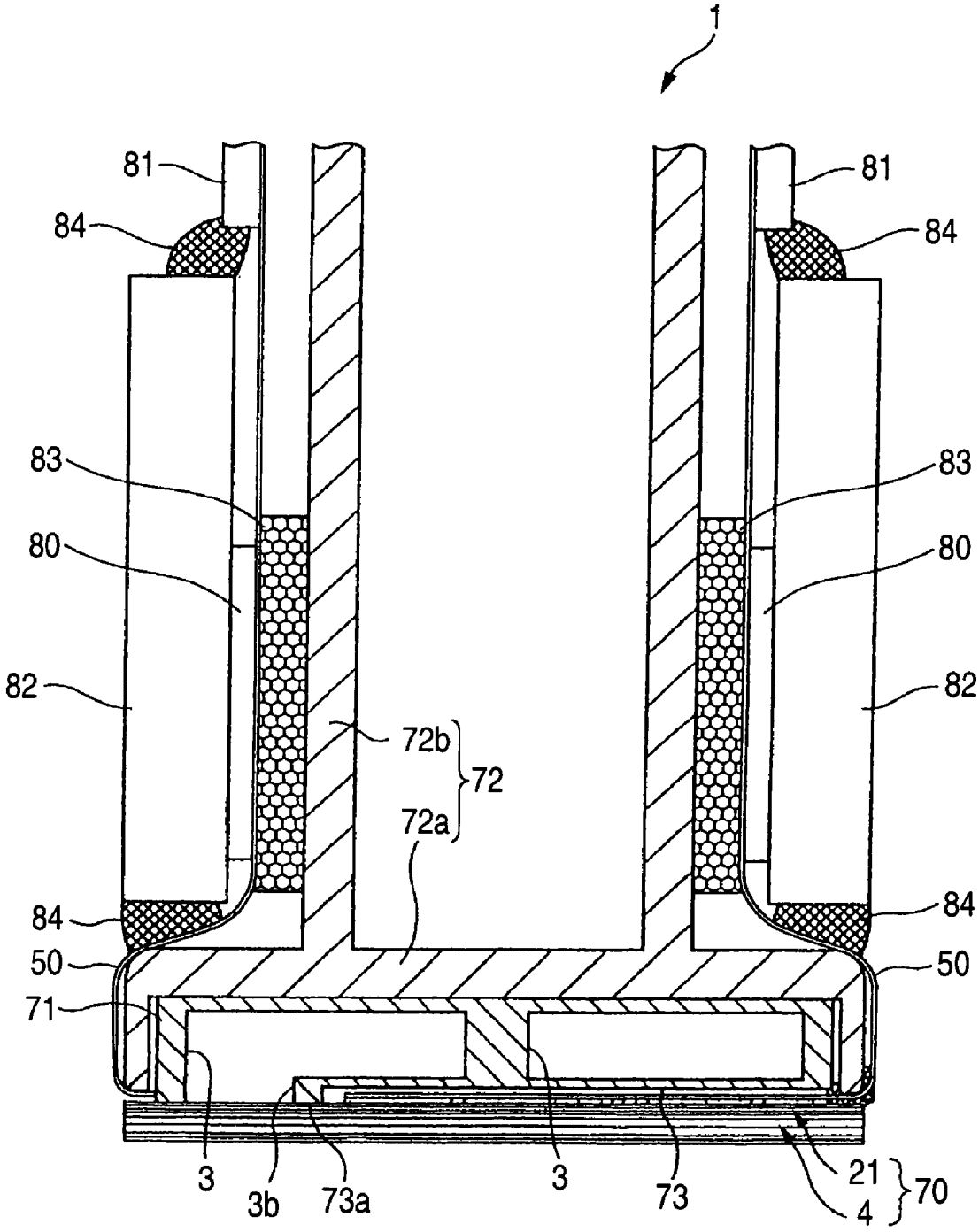
FIG. 2 is a sectional view taken along line II-II of FIG. 1.

The common electrode 34 is grounded at a not-shown area. With this configuration, the common electrode 34 is equally kept at the ground potential in the areas corresponding to all the pressure chambers 10. Besides, the individual electrodes 35 are connected to the driver IC 80 through the FPC 50 including different lead lines independent for the respective individual electrode 35. Thus, the potentials of the respective individual electrodes 35 corresponding to the respective pressure chambers 10 can be controlled (see FIGS. 1 and 2).

Next, the driving method of the actuator unit 21 will be described. The polarization direction of the piezoelectric sheet 41 of the actuator unit 21 is its thickness direction. That is, the actuator unit 21 has a so-called unimorph type structure in which the upper (that is, far from the pressure chamber 10) one piezoelectric sheet 41 is made a layer in which an active layer exists, and the lower (that is, close to the pressure chamber 10) three piezoelectric sheets 42 to 44 are made non-active layers. Accordingly, when the individual electrode 35 is made to have a specified positive or negative potential, for example, when the electric field and the polarization are in the same direction, the electric field application portion of the piezoelectric sheet 41 sandwiched between the electrodes functions as the active layer (pressure generation part), and shrinks in the direction normal to the polarization direction according to a piezoelectric transverse effect. On the other hand, since the piezoelectric sheets 42 to 44 are not influenced by the electric field, they are not spontaneously varied. Thus, a difference occurs in distortion in the direction vertical to the polarization direction between the piezoelectric sheet 41 of the upper layer and the piezoelectric sheets 42 to 44 of the lower layers. The whole of the piezoelectric sheets 41 to 44 is deformed to protrude toward the non-active side (unimorph deformation). At this time, as shown in FIG. 8A, since the lower surface of the piezoelectric sheets 41 to 44 is fixed to the upper surface of the separation wall (cavity plate) 22 for defining the pressure chamber 10, eventually, the piezoelectric sheets 41 to 44 are deformed to protrude toward the pressure chamber side. Thus, the volume of the pressure chamber 10 is decreased, the pressure of ink is raised, and the ink is ejected from the nozzle 8. Thereafter, when the individual electrode 35 is returned to have the same potential as the common electrode 34, the piezoelectric sheets 41 to 44 are returned to have the original shape. The volume of the pressure chamber 10 is returned to the original volume. Therefore, ink is sucked from the manifold 5 side.

Another driving method including the following steps may be adopted. The individual electrode 35 is previously made to have a potential different from the common electrode 34. The individual electrode 35 is once made to have the same potential as the common electrode 34 each time an ejection request is made. The individual electrode 35 can be made again to have the potential different from the common electrode 34 at specified timing. In this case, the piezoelectric sheets 41 to 44 are returned to have the original shape at the timing when the individual electrode 35 and the common electrode 34 have the same potential. Thus, the volume of the pressure chamber 10 is increased as compared with the initial state (state where the potentials of both the electrodes are different from each other), and ink is sucked from the manifold 5 side into the pressure chamber 10. Thereafter, the piezoelectric sheets 41 to 44 are deformed to protrude toward the pressure chamber 10 side at the timing when the individual electrode 35 is made again to have the potential different from the common electrode 34. The volume of the pressure chamber 10 is decreased. Thus, the pressure to the ink is raised, and the ink is discharged.

The actuator unit 21 and the plural plates 22 to 30 constituting the flow-path unit 4 shown in FIGS. 6 and 7 are bonded by adhesive and are laminated to each other. That is, after the adhesive is transferred onto one surface of the plate by a bonding tool or a roller, another plate to be bonded to the plate is stuck. Here, when the two plates are stuck together, for example, when the amount of the adhesive is large, or the adhesive is partially unevenly applied, there is a fear that the surplus adhesive overflows from between the two plates. Therefore, escape grooves for escaping the surplus adhesive are defined in the plural plates 22 to 30 constituting the flow-path unit 4. Among the plates 22 to 30, especially the cavity plate 22 forming the pressure chamber 10 will be described below.

Figure 9:
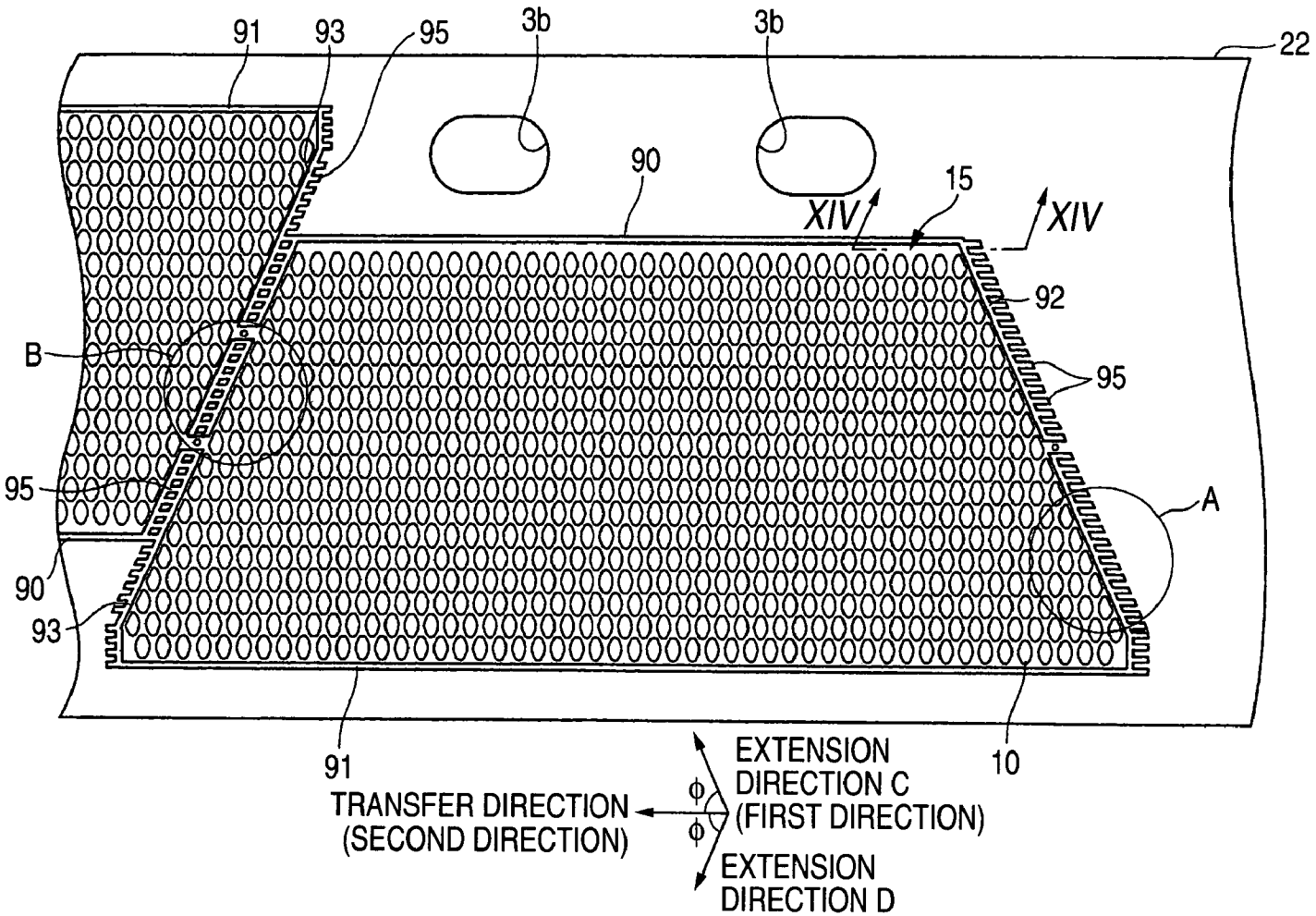
FIG. 9 is a partial plan view of a cavity plate.

As shown in FIG. 9, in the cavity plate 22, plural pressure chamber groups 15, which include the plural pressure chambers 10 arranged in a matrix form and each has a trapezoidal shape when viewed on a plane, are adjacently arranged in areas corresponding to the plural trapezoidal actuator units 21 (see FIG. 3) arranged in the staggered form. In trapezoidal areas in which these pressure chamber groups 15 are arranged, the piezoelectric sheet 44 of the lowermost layer of the plural laminated piezoelectric sheets 41 to 44 of the actuator unit 21 is stuck with adhesive.

Here, when the cavity plate 22 and the piezoelectric sheet 44 are bonded to each other and the surplus adhesive overflows from between the cavity plate 22 and the piezoelectric sheet 44, there is a fear that the adhesive climbs up to the surface of the piezoelectric sheet 41 of the uppermost layer. In this case, there occurs a case where the bonding tool used for bonding the piezoelectric sheet 44 is bonded to the piezoelectric sheet 44 and damage such as a fracture occurs in the piezoelectric sheet 44, a case where deformation of the piezoelectric sheets 41 to 44 at the time of ink ejection is hindered by the adhesive, or a case where poor connection between the individual electrode 35 of the surface of the piezoelectric sheet 41 and the FPC 50 occurs.

Then, the cavity plate 22 defines, with respect to each of the pressure chamber groups 15, four escape grooves 90 to 93 surrounding the trapezoidal area, when viewed on a plane, where the respective pressure chamber groups 15 are arranged. The escape grooves 90 to 93 communicate with each other at their ends. That is, as shown in FIG. 9, there are formed the two escape grooves 90 and 91 constituting two parallel opposite sides of the trapezoid and extending in the longitudinal direction (second direction) of the flow-path unit 4. Also, there are the two escape grooves 92 and 93 (functioning as a first escape groove) constituting two oblique sides of the trapezoid and extending in extension direction C and extension direction D having specified angles with respect to the longitudinal direction (the extension direction C and the extension direction D correspond to a first direction). When the piezoelectric sheet 44 is bonded to the cavity plate 22 and the surplus adhesive between the cavity plate 22 and the piezoelectric sheet 44 is pushed out to the outside, the surplus adhesive flows into the four escape grooves 90 to 93. Thus, the escape grooves 90 to 93 escape the surplus adhesive. The adhesive does not overflow from between the cavity plate 22 and the piezoelectric sheet 44.

By the way, in the cavity plate 22, with respect to the longitudinal direction (second direction) of the flow-path unit 4, the adhesive is transferred from the right of FIG. 9 by the bonding tool or the roller. Thus, at the time of transfer of the adhesive, a large amount of adhesive flows from the right as the upstream side in the transfer direction to the right end of the trapezoidal area of FIG. 9 where the pressure chamber group 15 is arranged. When the piezoelectric sheet 44 is bonded to the cavity plate 22 in such a state, the amount of the adhesive at the right end of the pressure chamber group 15 of the trapezoidal area in FIG. 9 becomes large. Thus, there is a fear that such adhesive cannot be escaped by only the one escape groove 92.

Figure 10A:
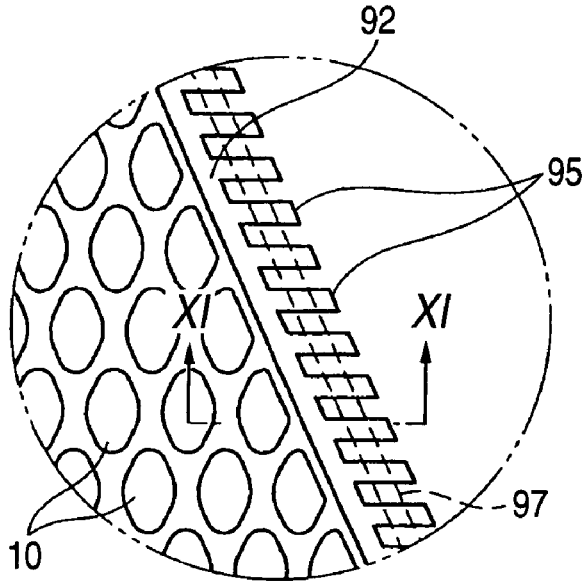
FIG. 10A is an enlarged view of a circular frame A of FIG. 9.
Figure 11:
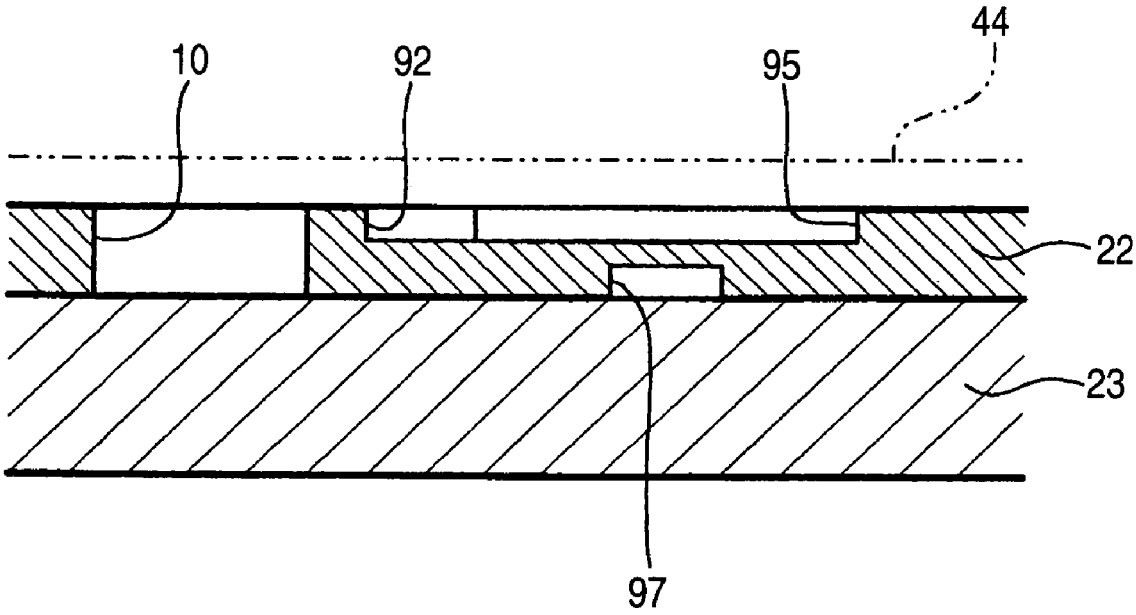
FIG. 11 is a sectional view taken along XI-XI of FIG. 10A.

As shown in FIGS. 9, 10A and 11, with respect to the escape groove 92 extending in the extension direction C, at the right side in FIG. 9 which is the upstream side in the transfer direction, plural recesses 95 are formed at specified intervals in the extension direction C. The plural recesses 95 escape the adhesive, which cannot be escaped by only the one escape groove 92. Besides, these plural recesses 95 extend in the second direction and communicate with the escape groove 92. Accordingly, the plural grooves 95 certainly escape the adhesive flowing from the upstream side in the transfer direction. Even if one of the escape groove 92 and the plural escape grooves 95 cannot escape the adhesive, the other communicating with the one can be escape such adhesive.

Besides, in FIG. 9, plural recesses 95 communicating with the escape groove 93 and extending in the second direction are formed at the left of the escape groove 93 arranged at the left of the trapezoidal area. Further, the escape groove 93 communicates with the escape groove 93 formed at the right of the trapezoidal area of the adjacent left pressure chamber group 15 through the plural recesses 95. Thus, between two pairs of the escape grooves 90 to 93 provided in the trapezoidal areas of the two adjacent pressure chamber groups 15, the adhesive which can not be escaped by one of them can be escaped to the other. The plural pressure chamber groups 15 are arranged in the longitudinal direction (second direction) of the flow-path unit 4 in the cavity plate 22. Incidentally, although not shown in FIG. 9, in the second and subsequent pressure chamber groups 15 from the right of FIG. 9, the escape grooves 92 (or the escape grooves 93) communicate with each other through the plural recesses 95 between the two adjacent pressure chamber groups 15. Accordingly, with respect to all the pressure chamber groups 15 arranged in the longitudinal direction of the flow-path unit 4, all the four escape grooves 90 to 93 surrounding each of the pressure chamber groups 15 communicate with each other through the plural recesses 95 intervening between the pressure chamber groups 15.

Figure 14A:
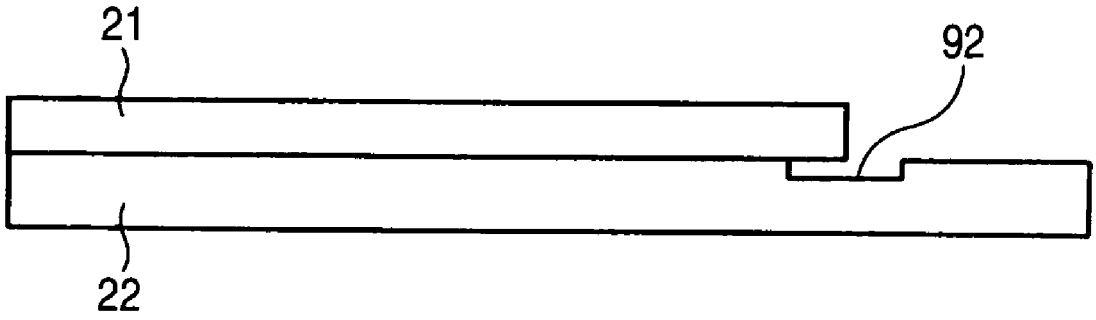
FIG. 14A-14B are sectional views of the cavity plate and the actuator unit.
Figure 14B:
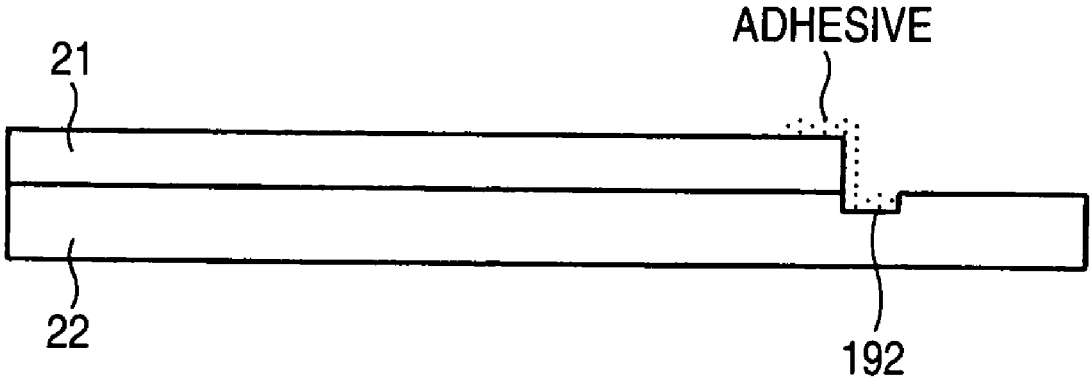

FIG. 14A is a section view taken along a line XIV-XIV in FIG. 9 and shows a state where the actuator unit 21 is bonded to the cavity plate 22. The escape groove 92 is defined so that when the actuator 21 is bonded to the cavity plate 22, an edge of the actuator unit 21 is located above the escape groove 92. In other words, a part of the escape groove 92 is located under the actuator unit 21. If the edge of the actuator unit 21 and an edge of an escape groove 192 were aligned as shown in FIG. 14B, the surplus adhesive that overflew from between the actuator unit 21 and the cavity plate 22 might rise along side edges of the escape groove 192 and actuator unit 21. In that case, the surplus adhesive might reach the top surface of the actuator unit 21. On the contrary, the edge of the escape groove 92 does not align with that of the actuator unit 21. Thus, there is no fear that the surplus adhesive rises along the side edge of the escape groove 92. Although not shown, the escape grooves 90, 91, 93 and the actuator unit 21 have the same arrangement relationship therebetween when the actuator unit 21 is bonded to the cavity unit 22.

At the lower (back) side of the cavity plate 22, and at positions slightly shifted from the four escape grooves 90 to 93 to the outside of the trapezoidal area of the pressure chamber group 15, four escape grooves for escaping adhesive to bond the base plate 23 are defined to surround the trapezoidal area in the lower surface of the cavity plate 22. FIG. 10A and 11 show one escape groove 97 of them. This escape groove 97 (functioning as a second escape groove) is formed in parallel to the escape groove 92 at the upper surface (top surface) side of the cavity plate 22. Although the other escape grooves formed in the back surface of the cavity plate 22 are not shown, similarly to the escape groove 97, they are respectively formed in parallel to the top surface side escape grooves 90, 91 and 93.

Here, if the two parallel escape grooves 92 and 97 arranged on the upper and the lower surfaces of the cavity plate 22 are formed at positions overlapping when viewed in a direction vertical to the paper surface of FIG. 9, a portion of the cavity plate 22 where its thickness is locally thin continues in the extension direction C. Thus, there is fear that the strength of the cavity plate 22 can not be sufficiently ensured. On the contrary, if the interval between the two escape grooves 92 and 97 is widened, the arrangement efficiency of the escape grooves 92 and 97 in the cavity plate 22 becomes worse. Also, the surface area of the cavity plate 22 becomes large by such configuration.

Figure 10B:
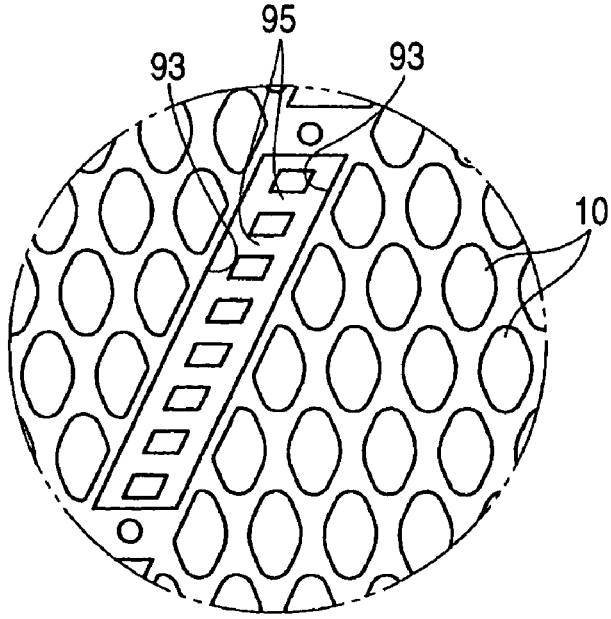
FIG. 10B is an enlarged view of a circular frame B of FIG. 9.

Thus, as shown in FIG. 11, the escape groove 97 of the lower side of the cavity plate 22 extending in the extension direction C is formed almost at the back side of the plural recesses 95 extending in the second direction crossing the extension direction C. Further, as shown in FIGS. 9 and 10, the plural recesses 95 are arranged at specified intervals in the extension direction C, extend in the second direction, and are formed into a comb-tooth shape in total. Thus, the two escape grooves 92 and 97 and the plural recesses 95 can be efficiently arranged on the upper and the lower surfaces of the cavity plate 22. A portion of the cavity plate 22 whose thickness becomes thin due to overlap of the plural recesses 95 and the back side escape groove 97 does not continue in the extension direction C. Accordingly, the strength of the cavity plate 22 can be ensured.

According to the inkjet head 1 as described above, following effects can be obtained.

The plural recesses 95 are formed at specified intervals in the extension direction C and at the transfer direction upstream side of the escape groove 92 formed at the upstream side portion of the trapezoidal pressure chamber group 15 in the transfer direction (second direction). Therefore, at the upstream side portion in the transfer direction in which a large amount of adhesive flows, the plural recesses 95 can escape the adhesive which can not be escaped by only the one escape groove 92. Besides, these plural recesses 95 extend in the second direction and communicate with the escape groove 92. Accordingly, the plural recesses 95 can certainly escape the adhesive flowing from the upstream side in the second direction. Even if one of the escape groove 92 and the plural recesses 95 cannot escape the adhesive, the other communicating with the one can escape such adhesive.

The escape grooves 92 and 93 provided between the two adjacent pressure chamber groups 15 communicate with each other through the plural recesses 95. Therefore, in the two pairs of the escape grooves 90 to 93 respectively provided for the trapezoidal areas of the two pressure chamber groups 15, the adhesive which can not be escaped by one of them can be escaped to the other.

The escape groove 97 for escaping the adhesive to bond the base plate 23 at the under surface of the cavity plate 22 is formed in parallel to the escape groove 92 of the upper surface. This escape groove 97 is formed almost at the back side of the plural recesses 95 extending in the second direction crossing the extension direction C. Besides, the plural recesses 95 are arranged at specified intervals in the extension direction C, and are formed into the comb-tooth shape in total. Thus, the two escape grooves 92 and 97 and the plural recesses 95 can be efficiently arranged on the upper and the lower surfaces of the cavity plate 22. Since the thin portion of the cavity plate 22 does not continue in the extension direction C, the strength of the cavity plate can be ensured.

Next, modified examples in which various modifications are added to the foregoing embodiment will be described.

1] At the time of transfer of adhesive, since the adhesive flows from the upstream side in the transfer direction, the amount of the surplus adhesive becomes large especially at the upstream side. As compared with the upstream side, the amount of the surplus is small at the downstream side in the transfer direction. Then, in FIG. 9, at the left of the trapezoidal area of the pressure chamber group 15 which is the downstream side in the transfer direction, the plural recesses 95 maybe omitted. Alternatively, even if the plural recesses 95 are provided at the left of the trapezoidal area, the plural recesses 95 may not communicate with the escape groove 93 of the adjacent pressure chamber group 15.

Figure 12:
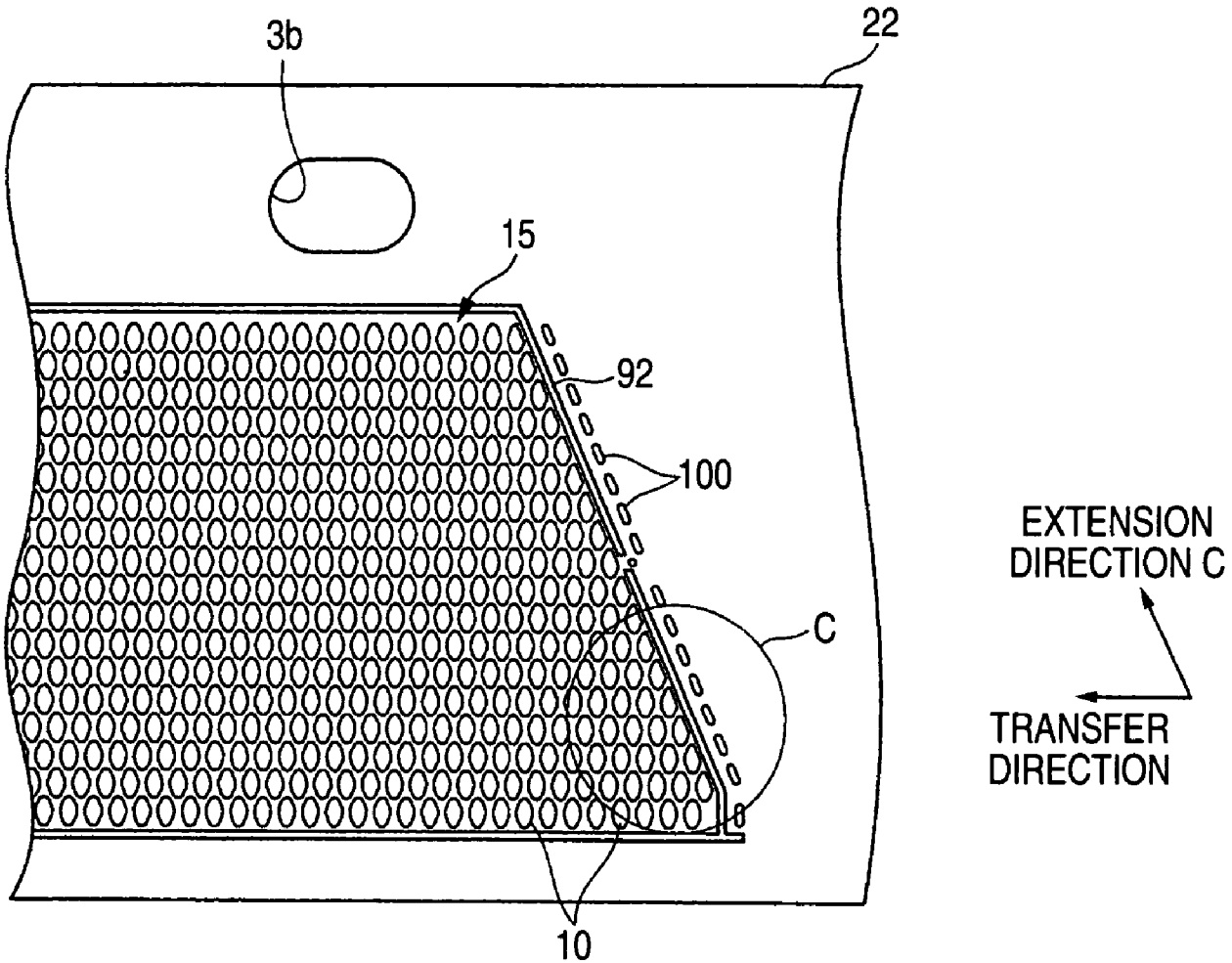
FIG. 12 is a partial plan view of a cavity plate of a modified example.
Figure 13:
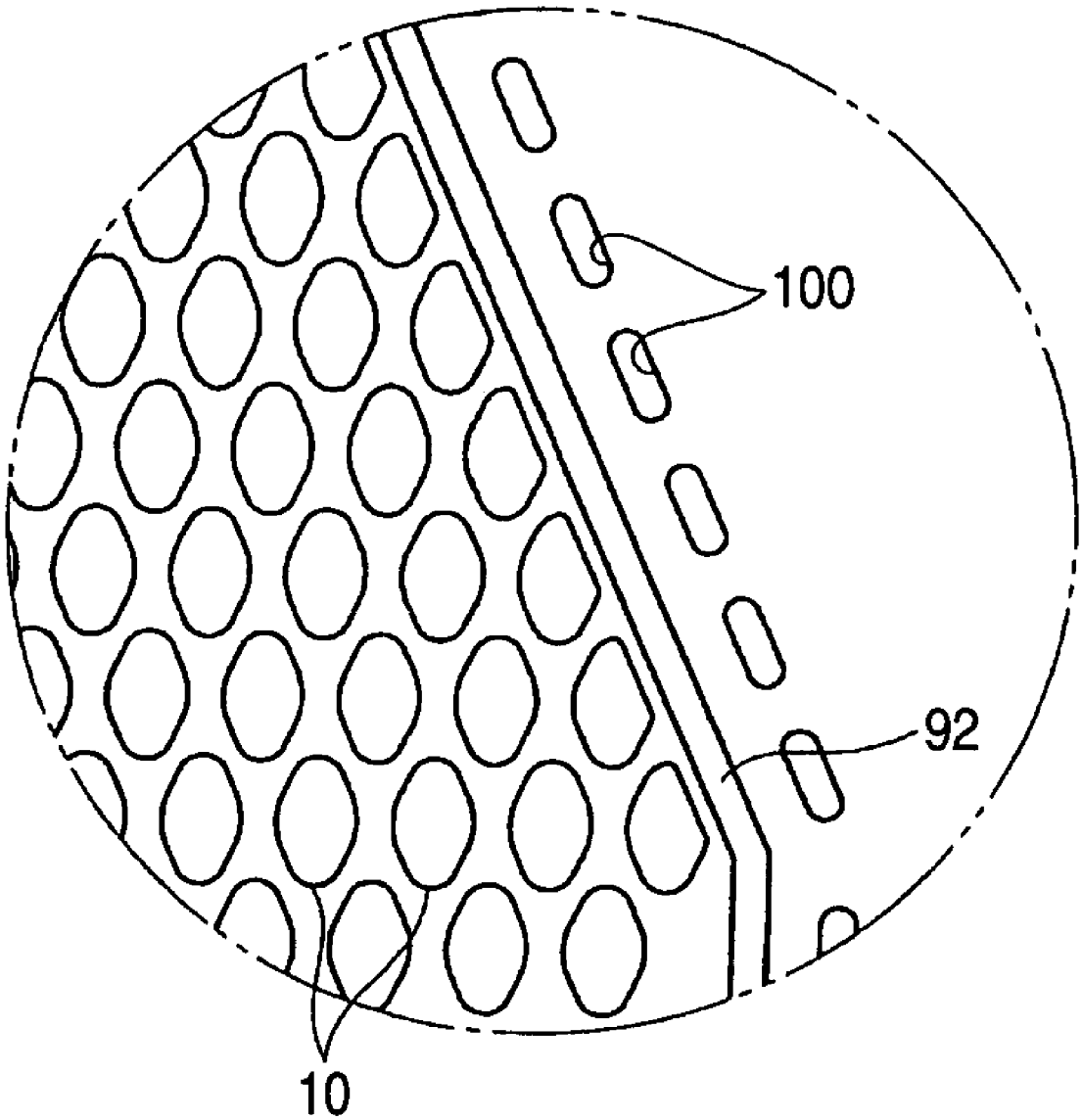
FIG. 13 is an enlarged view of a circular frame C of FIG. 12.

2] The escape groove 92 and the plural recesses 95 may not communicate with each other. For example, as shown in FIGS. 12 and 13, at the right side in FIG. 12 as the upstream side in the transfer direction with respect to the escape groove 92, plural recesses 100 each having a long hole shape extending in the extension direction C may be formed at specified intervals in the extension direction C.

3] In the foregoing embodiment, although the plural recesses 95 are formed in the cavity plate 22, the plural recesses may be formed in the other plates 23 to 30 defining the individual ink flow path 32. In this case, in the respective plates 23 to 30, plural flow path groups (for example, the sub-manifold 5*a*, the aperture 12, etc.) communicating with the plural pressure chambers 10 are formed at positions corresponding to the plural actuator units 21. With respect to escape grooves (first escape groove) respectively formed in the vicinities of the plural flow path groups and for escaping adhesive, plural recesses similar to those of the foregoing embodiment are formed.

What is claimed is:

1. An inkjet head comprising:

a flow-path unit including a plurality of plates that are stacked and define a common ink chamber and a plurality of ink flow paths communicating with the common ink chamber and a nozzle; and a piezoelectric sheet that is bonded onto one of the plates by an adhesive, wherein:

the one of the plates defines, on one surface onto which the piezoelectric sheet is bonded, a first groove that extends in a first direction and is adjacent a first pressure chamber group, a second groove that extends in the first direction and is adjacent a second pressure chamber group, and a plurality of recess portions in a second direction, which intersects with the first direction;

the recess portions are spaced from each other, and each connect the first groove to the second groove; and the first groove and the second groove allow the adhesive to escape when the piezoelectric sheet is bonded.

2. The inkjet head according to claim 1, wherein the recess portions are spaced from each other at a predetermined interval in the first direction.

3. The inkjet head according to claim 1, wherein the second direction is identical to a longitudinal direction of the flow-path unit.

4. The inkjet head according to claim 1, wherein the recess portions communicate with the first groove.

5. The inkjet head according to claim 4, wherein the recess portions are arranged to form a comb-tooth shape.

6. The inkjet head according to claim 1, wherein:

the flow-path unit includes:

a plurality of pressure-chamber groups each of which has a plurality of pressure chambers; and a plurality of flow-path groups each of which has the plurality of flow paths communicating with the pressure chambers;

the one of the plates defines at least one of (A) parts of the pressure chambers and (B) parts of the flow paths; and the one of the plates defines on the one surface third grooves that extend in a direction different from the first direction;

the first groove includes first grooves; and the first grooves and the third grooves are defined in the vicinity of at least one of the pressure-chamber groups and the flow-path groups and communicate with each other through the recess portions.

7. The inkjet head according to claim 6, wherein:

the first grooves are defined along one side of the at least one of the pressure-chamber groups and the flow-paths groups; and the third grooves are defined along another side of the at least one of the pressure-chamber groups and the flow-paths groups.

8. The inkjet head according to claim 1, wherein:

the flow-path unit includes a plurality of pressure-chamber groups each of which has a plurality of pressure chambers;

the one of the plates defines parts of the pressure chambers; and the one of the plates defines on the one surface third grooves that extend in a direction different from the first direction;

the first groove includes first grooves; and the first grooves and the third grooves are defined in the vicinity of the pressure-chamber groups and communicate with each other through the recess portions.

9. The inkjet head according to claim 6, wherein:

the one of the plates defines on the one surface fourth grooves that extend in the second direction;

the fourth grooves communicate with the first and third grooves; and the first, third, and fourth grooves surround the at least one of the pressure-chamber groups and the flow-path groups.

10. The inkjet head according to claim 1, wherein:

the one of the plates defines on the other surface a backside groove that extends in parallel with the first groove; and a part of the backside groove is located on a backside of the recess portions.

11. The inkjet head according to claim 10, wherein the backside groove communicates with the recess portions.

12. The inkjet head according to claim 1, wherein an edge of the piezoelectric sheet is arranged above the first groove.

13. The inkjet head according to claim 1, wherein the piezoelectric sheet changes volume of the pressure chambers.

14. The inkjet head according to claim 1, wherein each of the recess portions extends from the first groove.

15. The inkjet head according to claim 1, wherein each of the recess portions is fluidly connected to the first groove.

* * * * *